US006622416B2

(12) United States Patent
Kim

(10) Patent No.: US 6,622,416 B2
(45) Date of Patent: Sep. 23, 2003

(54) TARGET AND NAVIGATION ILLUMINATORS FOR FIREARMS

(75) Inventor: Paul Youngcho Kim, Westminster, CA (US)

(73) Assignee: Surefire, LLC, Fountain Valley, CA (US)

( * ) Notice: Subject to any disclaimer, the term of this patent is extended or adjusted under 35 U.S.C. 154(b) by 51 days.

(21) Appl. No.: 09/878,709

(22) Filed: Jun. 11, 2001

(65) Prior Publication Data

US 2002/0100204 A1 Aug. 1, 2002

Related U.S. Application Data

(60) Provisional application No. 60/259,726, filed on Jan. 4, 2001.

(51) Int. Cl.[7] ..... F41A 15/00

(52) U.S. Cl. ..... 42/146; 42/114; 362/110; 362/114

(58) Field of Search ..... 42/146, 114; 362/110, 362/114

(56) References Cited

U.S. PATENT DOCUMENTS

| | | | |
|---|---|---|---|
| 1,423,911 | A | 7/1922 | Cardwell |
| 1,448,352 | A | 3/1923 | Barany et al. |
| 1,579,671 | A | 4/1926 | Staats-Oels |
| 1,865,127 | A | 6/1932 | McKeen |
| 1,950,835 | A | 3/1934 | Zajac |
| 2,137,230 | A | 11/1938 | Arden |
| 2,190,035 | A | 2/1940 | Loungway |
| 2,209,524 | A | 7/1940 | Key |
| 2,209,702 | A | 7/1940 | Meginniss |
| 2,236,736 | A | 4/1941 | Scott |
| 2,450,584 | A | 10/1948 | Dodge |
| 2,523,786 | A | 9/1950 | Soreng |
| 2,597,565 | A | 5/1952 | Chandler et al. |
| 2,912,566 | A | 11/1959 | Cornett |
| 3,086,090 | A | 4/1963 | Carroll |
| 3,596,078 | A | 7/1971 | Owens |
| 3,739,167 | A | 6/1973 | Avery |
| 3,743,915 | A | 7/1973 | Struck |
| 4,249,234 | A | 2/1981 | Park et al. |
| 4,533,980 | A | 8/1985 | Hayes |
| 4,677,533 | A | 6/1987 | McDermott et al. |
| 4,814,957 | A | 3/1989 | Dennis |
| 4,856,218 | A | 8/1989 | Reynolds, Jr. |
| 4,947,291 | A | 8/1990 | McDermott |
| 4,963,798 | A | 10/1990 | McDermott |
| 4,985,813 | A | 1/1991 | Putman |
| 5,064,988 | A | 11/1991 | E'nama et al. |
| 5,081,568 | A | 1/1992 | Dong et al. |

(List continued on next page.)

*Primary Examiner*—J. Woodrow Eldred
(74) *Attorney, Agent, or Firm*—David Weiss

(57) ABSTRACT

A firearm illuminator for selectively providing low intensity illumination to assist the firearm user to navigate his or her surroundings in dark environments, as well as for selectively providing high intensity illumination of a target. The preferred embodiment includes a vertical handgrip having a battery compartment in the handgrip. A battery retainer cap assembly for the battery compartment includes a battery enable/disable mechanism and a safety latch is provided on the handgrip or battery housing for assuring the retainer cap assembly's secure attachment to the battery housing.

54 Claims, 3 Drawing Sheets

U.S. PATENT DOCUMENTS 5,161,095 A 11/1992 Gammache
5,161,879 A 11/1992 McDermott
5,174,648 A 12/1992 Clary et al.
5,359,779 A 11/1994 Polk et al.
5,400,540 A 3/1995 Solinsky et al.
5,590,951 A 1/1997 Matthews
5,601,359 A 2/1997 Sharrah et al.
5,629,105 A 5/1997 Matthews
5,642,932 A 7/1997 Matthews
5,685,637 A 11/1997 Chapman et al.
5,704,155 A * 1/1998 Primeau, IV ..... 42/114
5,722,755 A 3/1998 Slape
5,871,272 A 2/1999 Sharrah et al.
5,984,494 A 11/1999 Chapman et al.
6,019,482 A 2/2000 Everett
6,046,572 A 4/2000 Matthews et al.
6,095,661 A 8/2000 Lebens et al.
6,230,431 B1 * 5/2001 Bear ..... 42/117

* cited by examiner

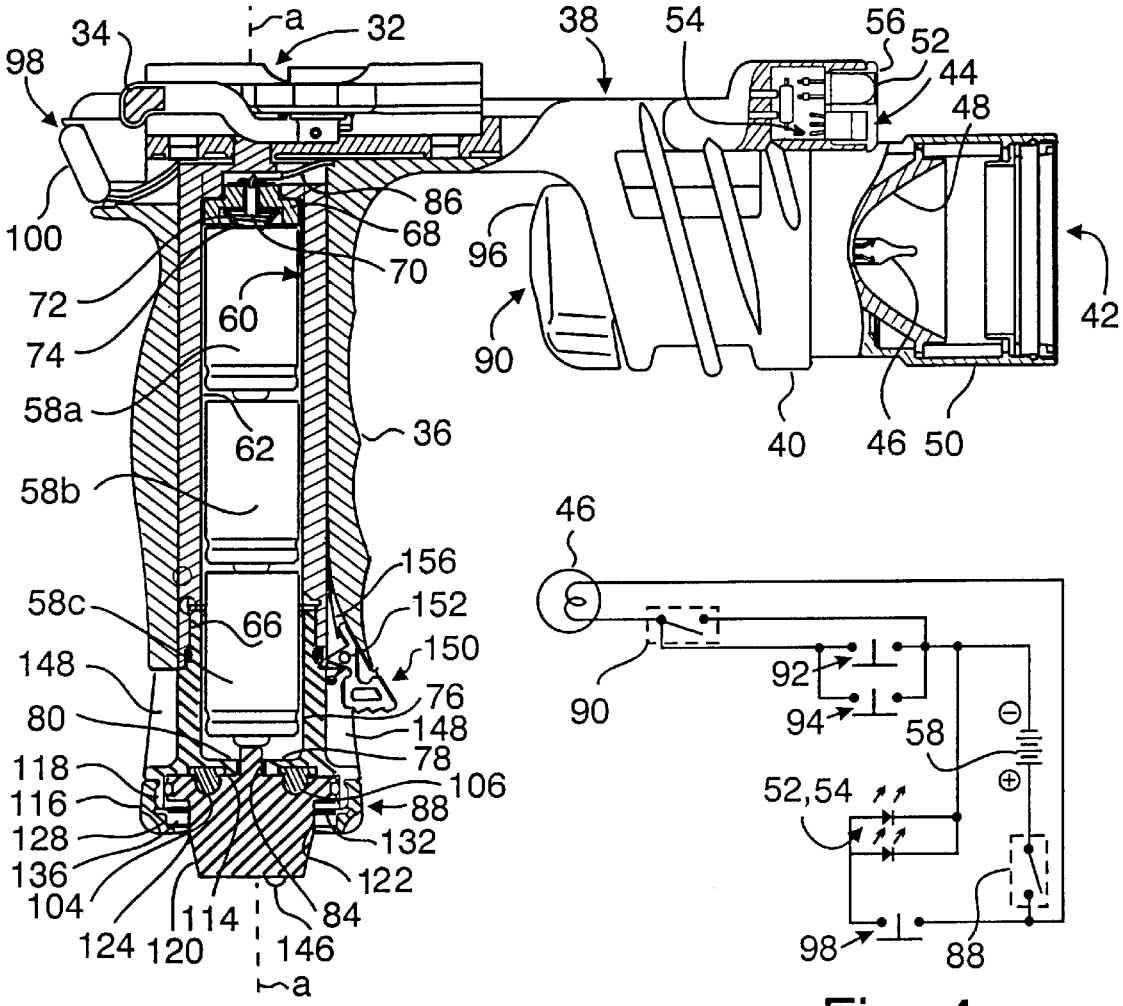
Fig. 3
Fig. 4
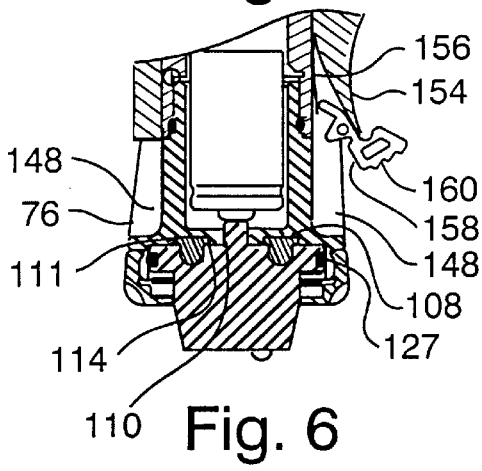
Fig. 6
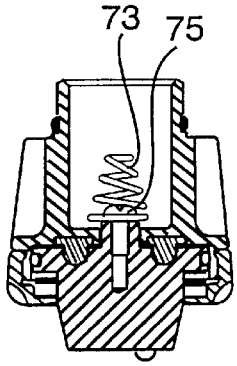
Fig. 15
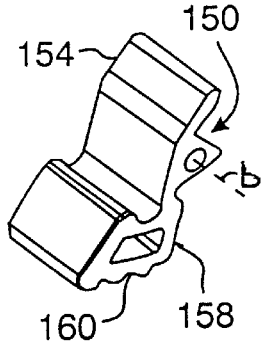
Fig. 5

TARGET AND NAVIGATION ILLUMINATORS FOR FIREARMS

CROSS REFERENCE TO RELATED APPLICATION

This application claims the benefit of U.S. Provisional Application Ser. No. 60/259,726, filed Jan. 4, 2001, which application is incorporated herein by reference.

BACKGROUND OF THE INVENTION

This invention relates to illuminators for firearms, and more particularly to illuminator devices for selectively providing low intensity illumination to assist the user to navigate his or her surroundings in dark environments, as well as for selectively providing high intensity illumination of a target, and to battery compartments and switching devices useful therewith.

Target illuminators for attachment to firearms are well known. Illuminator devices have been used on tactical weapons such as carbines for illuminating targets for being fired upon, as well as for momentarily blinding and disorienting an adversary. In dark environments, whether outside at night or indoors, a military or law enforcement person engaged in an adversarial situation may find it difficult or impossible to efficiently and noiselessly navigate his or her surroundings. To provide visual assistance by momentarily turning on a target illuminator may betray his presence or even his position.

Vertical fore-end handgrips for tactical weapons such as carbines are also well known. Such handgrips may be attached to a rail interface system device secured to the fore-end of a carbine, for providing assistance in physically controlling the carbine when various accessories are secured to its fore-end rail interface system device.

SUMMARY OF THE INVENTION

Against this background, a primary aspect of the present invention provides an illuminator for a firearm for selectively generating low intensity illumination for assisting the firearm user to navigate his surroundings, i.e. to provide low level illumination for assisting the user to find his way to a point of entry without betraying his presence or position with high intensity light. A preferred embodiment of the present invention combines the low intensity navigation illuminator with a high intensity target illuminator, and is configured with a vertical fore-end handgrip adapted for attachment to a long firearm such as a carbine or other rifle or a shotgun. The vertical handgrip includes a battery compartment with a bottom cap assembly for retaining the battery as well as a safety latch for assuring the secure attachment of the cap assembly to the battery compartment. The battery retainer cap assembly further includes a readily accessible enable/disable switch for permitting the user to positively prevent operation of the illuminators.

Specifically, according to one aspect of the present invention, an illumination apparatus is provided for a firearm comprising the combination of: a housing adapted to be secured to the firearm; a high intensity light source carried by the housing and operable by a user for illuminating a target when the housing is secured to the firearm; and at least one low intensity light source carried by the housing and operable by the user for illuminating the user's surroundings when the housing is secured to the firearm. In the preferred embodiment, the at least one low intensity light source includes a light emitting diode. The housing of the preferred embodiment includes a handgrip substantially vertically disposed beneath the firearm's barrel when the housing is secured to the firearm and the firearm is horizontally disposed, the housing further including a forward portion carrying the high intensity and low intensity light sources. The vertical handgrip includes a compartment for containing a battery, and preferably a replaceably removable battery retainer cap at the lower end of the handgrip for removably retaining the battery in the battery compartment.

In accordance with another aspect of the present invention, the battery compartment retainer cap is protected against inadvertent removal such as by vibrations generated by the firearm. For providing such protection, the battery retainer cap is threadedly attached to the lower end of the handgrip and includes a plurality of circumferentially-spaced vertically-oriented grooves along the outer surface thereof; and a lever is pivotally attached to the handgrip, the lever having a lower leg radially inwardly biased and normally cooperating with a one of the grooves for preventing rotation of the battery retainer cap with respect to the handgrip, the leg including a portion adapted for manipulation by the user for outwardly pivoting the leg from the one groove for permitting the user to rotate the battery retainer cap with respect to the handgrip.

A further aspect of the present invention, involving the battery compartment which is useful in other electrical appliances as well, concerns an actuator mounted to the battery retainer cap operable by a user for alternatively connecting and disconnecting the battery in a circuit thereby respectively enabling and disabling the battery. The battery compartment includes an electrically conductive sleeve and the battery retainer cap is electrically conductive and conductively retained by the sleeve for containing the battery with one terminal of the battery in conductive engagement with a conductive floor or partition of the battery retainer cap when the battery is enabled. The other terminal of the battery contacts a conductive spring electrically insulated from the sleeve and downwardly biasing the battery, the sleeve and the spring electrically connected to the circuit. The partition or floor includes a bore therethrough, the actuator includes an electrically insulating post in the bore, and the actuator is actuable by the user for upwardly displacing the post to urge the one terminal of the battery to conductively disengage from the conductive partition or floor for disabling the battery and alternatively for downwardly displacing the post such that the one terminal of the battery conductively engages the floor for enabling the battery. The preferred embodiment further includes an actuator retainer cap retainably mounting the actuator to the battery retainer cap; two projections depending from the battery retainer cap and radially spaced from the bore; two arcuate recesses in the actuator and concentrically spaced about the post for respectively receiving the projections, the depth of each of the recesses increasing from one end to the other end thereof; and a compression spring held by the actuator retainer spring and acting upon the actuator for maintaining the recesses in engagement with the projections. Each end of each of the arcuate recesses preferably includes a detent for releaseably retaining an associated one of the projections.

The preferred embodiment of the present invention, including both high intensity and low intensity light sources, further includes: an ON/OFF switch on the housing and operable by the user for alternatively turning on and off the high intensity light source when the battery is enabled; at least one momentary switch on the handgrip operable by the user for momentarily turning on the high intensity light source when the battery is enabled; and a momentary switch on the housing operable by the user for momentarily turning on the at least one low intensity light source when the battery is enabled.

BRIEF DESCRIPTION OF THE DRAWINGS

The novel features believed to be characteristic of the invention, together with further advantages thereof, will be better understood from the following description considered in connection with the accompanying drawings in which preferred embodiments of the present invention and various aspects thereof are illustrated by way of example. It is to be understood, however, that the drawings are for the purpose of illustration and description only and are not intended as a definition of the limits of the invention.

FIG. 3 is a side elevation view of the device of FIG. 2, partially broken away and partially in cross-section to show features of the present invention;

FIG. 4 is a schematic diagram of an electric circuit included in the preferred embodiment of FIG. 3;

FIG. 5 is a perspective view of the battery compartment safety latch shown in FIG. 3 in its normal position;

FIG. 6 is a fragment of the lower portion of FIG. 3, showing the safety latch in its actuated position;

FIG. 15 is a fragment of the lower portion of FIG. 3 modified to show a variation of the battery enable/disable switch assembly.

DETAILED DESCRIPTION OF THE PREFERRED EMBODIMENTS

Figure 1:
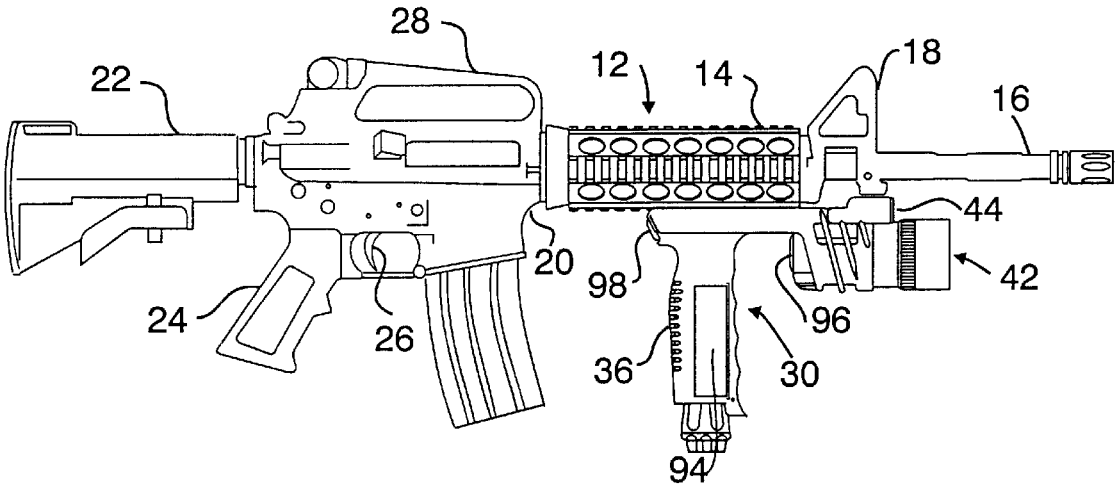
FIG. 1 is a side elevation view of a preferred embodiment of a combined target illuminator and navigation illuminator device in accordance with the present invention, mounted to a firearm.

Turning first to FIG. 1, there is illustrated a firearm 12, specifically a carbine such as manufactured by Colt Firearms (Division of Colt Industries, of Hartford, Conn.), equipped with a rail interface system device 14 such as manufactured by Knight's Manufacturing Co. (of Vero Beach, Fla.) secured to the carbine and surrounding the carbine's barrel 16 along the carbine's fore-end section between the front sight 18 and lower receiver 20. The carbine 12 further includes a stock 22, pistol grip 24, trigger 26 and upper receiver 28 with (in this example) carrying handle and rear sight. Such carbines 12 and rail interface system devices 14 are well known in the firearms art.

A preferred embodiment of the target/navigator illuminator device 30 in accordance with the present invention is mounted to the underside of the rail interface device 14, and hence under the barrel 16 and forwardly of the carbine's lower receiver 20. The illuminator device 30 is more clearly shown in FIGS. 2 and 3, and includes a mounting plate assembly 32 for mounting the illuminator device 30 to the rail interface device 14. Such mounting plate assemblies are well known in the firearms art, and may include a single lever platform mount 34 of the type shown in FIGS. 2 and 3. The preferred illuminator device 30 includes a handle or handgrip 36 with its longitudinal axis a—a substantially vertically disposed beneath the carbine's fore-end section when the barrel 16 is horizontally disposed, in a position such that a user of the firearm 12 may comfortably grasp the foregrip or handgrip 36 with one hand while the user's other hand grasps the pistol grip 24 for permitting firing of the firearm 12.

The device 30 includes a housing 38, preferably of one-piece construction and molded of a polymeric material such as nylon, the housing 38 including the vertical grip 36 as well as a forward housing portion 40 for accommodating a high-intensity light source assembly 42 and at least one low intensity light source assembly 44, forwardly of the vertical grip 36. In the preferred embodiment, two low intensity light source assemblies 44 are provided, above the assembly 42, the low intensity light source assemblies 44 being similar to and laterally spaced from each other.

The high intensity light source assembly 42 is for illuminating a target and includes an electric lamp 46, a parabolic reflector 48 and bezel assembly 50, and may be of the type described in U.S. patent application Ser. No. 09/229,915, of Paul Y. Kim and John W. Matthews, which application is incorporated herein by reference. Typical light output of the target illuminator light source assembly 42 may be 125 to 225 lumens or greater.

The low intensity light source assemblies 44, each preferably including a light emitting diode or LED 52 with conventional resistor and regulator combination 54, are secured in the housing front portion 40 that includes an aperture or window 56 for permitting each LED 52 to emit light therethrough. The purpose of the LEDs 52 is to provide a low intensity illumination to a user's surroundings, for permitting the user to get about or navigate in otherwise unlighted or dark surroundings. It is preferred that the LEDs 52 be of a type that emits white light of approximately 1.5 lumens light output each, although LEDs emitting colored light may be useful in certain environments. Although low intensity filament bulbs or other types of lamps may be used instead of the LEDs 52, LEDs are preferred because of their low energy consumption and long life.

In one manner of using the navigation illuminator feature of the invention, the user may in appropriate situations point his weapon and hence the navigation illuminator 44 downwardly, illuminating his dark surroundings sufficiently to navigate without attracting the attention of an enemy. The navigation illuminator 44 may be attached to other firearms such as handguns as well as to long arm weapons.

The energy source for the target illuminator 42 and the navigation illuminator 44 is provided by a battery 58 which may include a plurality of battery cells, such as the three battery cells 58*a*, 58*b* and 58*c* (see FIGS. 3 and 4) in series arrangement, such as a 9-volt battery 58 consisting of three 3-volt lithium battery cells 58*a, b, c*.

The battery 58 is contained within a battery housing 60 including an electrically conductive sleeve 62 aligned within the vertical grip 36 and an electrically conductive battery retainer cap 76 threadably engaging the lower end of the sleeve 62 by mating threads 66. The upper end of the electrically conductive sleeve 62 is closed with an electrically insulating plug 68 having an aperture through which a conductive wire 70 is attached to a retained conductive helical spring 72 to provide the upper electrical contact for the battery's negative terminal 74.

The battery retainer cap 76 includes an electrically conductive partition or floor 78 having a central bore 80 therethough. The interior diameter of the battery retainer cap 76 is the same as the interior diameter of the battery housing sleeve 62, and the battery retainer cap 76 contains a portion of the lowermost battery cell 58*c*. The positive battery terminal 82 faces and is normally conductively disengaged from the battery retainer cap 76 (e.g. disengaged from the floor 78) and hence from the sleeve 62, by means of an electrically insulating post 84 retractably extending through the bore 80 with the post's upper surface extending above the floor 78 and contacting the battery positive terminal 82 for urging the battery 58 upwardly against the spring 72. The battery 58 is enabled when the lowermost battery cell 58*c* positive terminal 82 conductvely engages the battery retainer cap 76 by contacting the conductive floor 78 (the battery positive terminal 82 having a diameter greater than the diameter of the central bore 80), thereby electrically communicating with the sleeve 62 and an electrically conductive wire 86 conductively attached to the sleeve 62. The insulating post 84 is part of an enable/disable switch assembly 88 that permits the firearm user to positively prevent operation of the target illuminator 42 and the navigation illuminator 44, such as when preservation of absolute darkness is essential in cases where accidental actuation of either illuminator 42 or 44 may disclose the user's position to a possible criminal or enemy. In addition, the enable/disable switch 88 is useful for preventing battery drain through inadvertent actuation of other switches for energizing the illuminators 42 and/or 44 when the target/navigator illuminator device 30 (alone or mounted to the firearm 12) may be temporarily stored or transported without removal of the battery 58 therefrom.

In the enable/disable switch activator variation shown in FIG. 15, a lower conductive helical spring 73 is secured to the top of the insulatied post 84 by a conductive screw 75, for providing a lower electrical contact for the battery's lower terminal. This variation may be preferred where the battery 58 is arranged with its negative terminal downwardly oriented, i.e. with the battery negative terminal 74 of the lowermost battery cell 58*c* contacting the lower spring 73 and with the upper spring 72 providing the upper electrical contact for the battery's positive terminal 82. In such orientation of the battery 58, of course, the circuit schematic of FIG. 4 would show the battery 58 and the light emitting diodes 52, 54 with reversed polarity. The lower spring 73 extends laterally of the post 84 and does not contact the conductive floor 78 when the battery 58 is disabled. The battery 58 is enabled when the lowermost battery cell 58*c* negative terminal 74 conductively engages the battery retainer cap 76, by means of the electrically insulating post 84 being retracted such that the lower portion of the lower conductive spring 73 contacts the conductive floor 78, thereby electrically communicating with the sleeve 62 for completing the electrical circuit.

In either case, when the battery 58 is enabled (i.e., when the insulating post 84 is retracted such that the lower battery terminal is in electrically conductive engagement with the battery retainer cap 76), electrical energy from the battery 58 is supplied to the lamp 46 of the target illuminator 42 either through actuation of a constant ON/OFF switch, or through actuation of one or the other of two momentary switches 92, 94. The ON/OFF switch 90 provides a constant ON or a constant OFF by closing or opening a conductive path to the lamp 46, through user control of an ON/OFF switch knob 96 by say a one-eighth turn of the knob 96. Such switching circuits are well known in the art.

Figure 2:
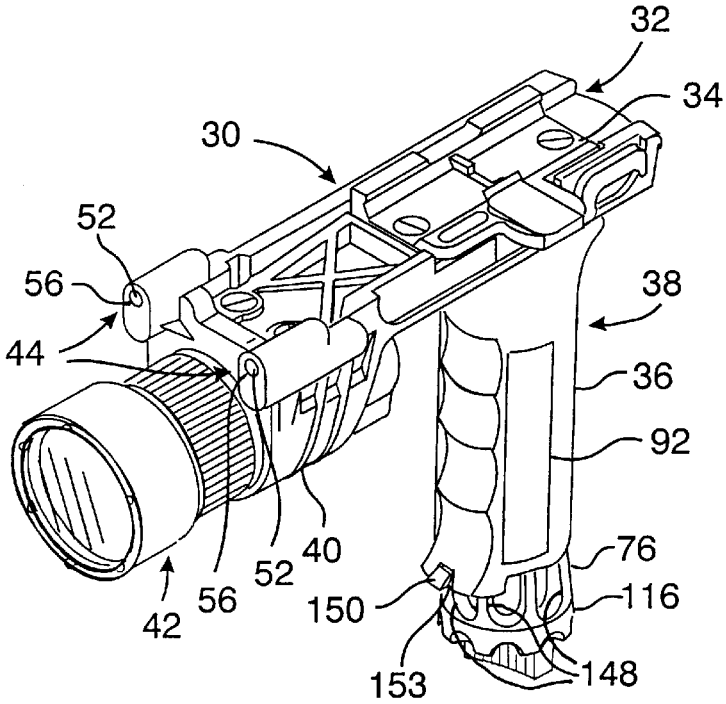
FIG. 2 is an enlarged perspective view of the target/navigator illuminator device of FIG. 1.

The momentary switches 92, 94 provide the firearm user with instantaneous light control. Momentary switches are well known in the art and include the so-called tape switches used in firearm systems. Their construction typically includes spaced electrodes in a flexible enclosure that are squeezed together and thus brought into electrical contact with each other by the firearm user when energization of the illuminator is desired, through conventional electrical circuitry including the normally spaced electrodes. The momentary tape switches 92, 94 are situated on opposite sides of the vertical grip 36, as shown in FIGS. 1 and 2. One or the other of these tape switches 92, 94 (depending upon which one of the user's hands is employed for grasping the vertical grip 36) is squeezed by the user's fingers when the user desires to energize the target illuminator lamp 46, which remains energized for only as long as one of the tape switches 92, 94 remains squeezed (see FIG. 4).

In addition, when the battery 58 is enabled, the diodes 52 of the navigation illuminator 44 may be energized upon actuation of switch 98, which is preferably a momentary switch (see FIGS. 3 and 4). The navigation illuminator switch 98 is preferably actuated by a pushbutton device 100 situated at the rear of the illuminator device 30 and above the vertical grip 36. Accordingly, the navigation illuminator switch 98 may be actuated by the user pressing his or her thumb against the pushbutton 100, such thumb being of the same hand used to grasp the vertical grip 36. Pushbutton-activated momentary switches 98, 100 are well known in the art, and as used in the present invention the LEDs 52 remain energized for only as long as the pushbutton 100 is depressed.

Figure 12:
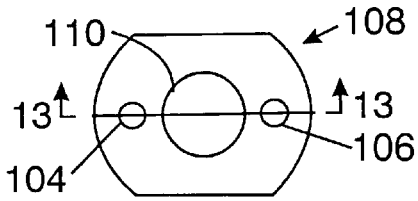
FIG. 12 is a bottom view of a plate element of the enable/disable switch assembly shown in FIG. 3, for cooperative engagement by the switch actuator of FIGS. 7–11.
Figure 13:
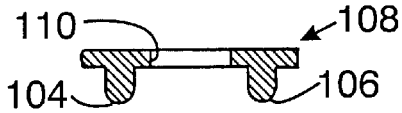
FIG. 13 is a cross-sectional elevation view of the switch plate of FIG. 12, taken along the line 13—13 of FIG. 12 in the direction of the appended arrows.

The various components of the enable/disable switch assembly 88 are shown in FIGS. 3 and 7–14. The enable/disable switch actuator 120 (FIGS. 3 and 7–11), constructed preferably of a polymeric material such as nylon, cooperates with two downwardly extending generally cylindrical projections 104, 106 of a plate 108 which may also be of nylon (FIGS. 3, 12 and 13). The projections 104, 106 have rounded ends and are laterally spaced from each other, on either side of a circular central aperture 110 in the plate 108. The plate 108 is held against lateral and rotational movement within a conforming recess 111 in the bottom surface 112 of the floor 78 of the battery retainer cap 76 (FIGS. 3, 6 and 14), the central boundary of the recess 111 comprising an annular boss 114 about the central bore 80 through the floor 78. The depth of the recess 111 is approximately the same as the thickness of the plate 108, so that the projections 104, 106 effectively depend from the bottom surface 112.

Figure 9:
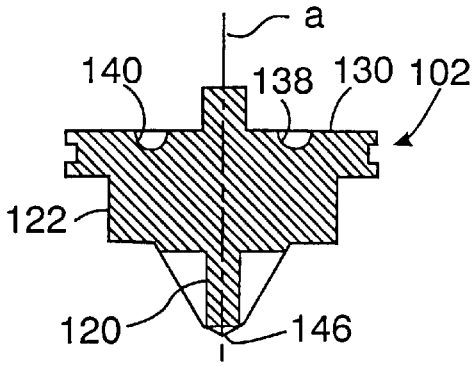
FIG. 9 is an elevational cross-sectional view of the switch actuator, taken along the line 9—9 of FIG. 7 in the direction of the appended arrows.
Figure 14:
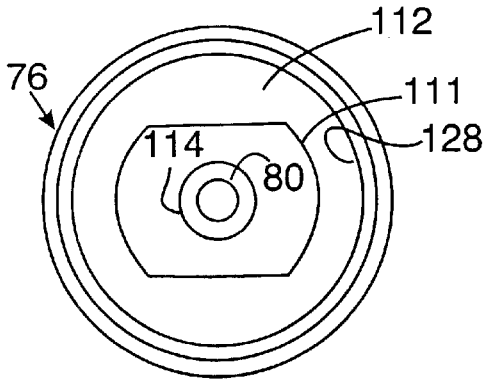
FIG. 14 is a bottom view of the battery retainer cap shown in FIGS. 3 and 6.

The enable/disable actuator 102 is supported for cooperation with the battery 58, with the actuator's central vertical post 84 extending within the central bore 80, by actuator retaining cap 116 threadedly engaging the bottom of the battery retainer cap 76 by mating threads 118. The actuator 102 is rotatable about its axis a, which coincides with the longitudinal axis of the vertical grip 36, and the actuator includes a depending handle 120 for implementing such rotation through the user's grasping the handle 120 between his thumb and a finger and rotating the handle through a 90° arc as illustrated in FIG. 9 as compared to FIG. 8. The lower cylindrical portion 122 of the actuator 102 is rotatable within a bore 124 through the bottom of the actuator retaining cap 116, and the upper cylindrical portion 126 of the actuator 102 (with interfacing O-ring 127) is rotatable within an inner cylindrical wall 128 at the bottom of the battery retainer cap 76. The upper surface 130 of the actuator 102 is urged toward the bottom surface 112 of the battery retainer cap 76 by means of a compression spring 132 about the actuator's lower cylindrical portion 122 and trapped between the actuator's annular shoulder 134 and the actuator retaining cap's interior annular ledge 136.

Figure 7:
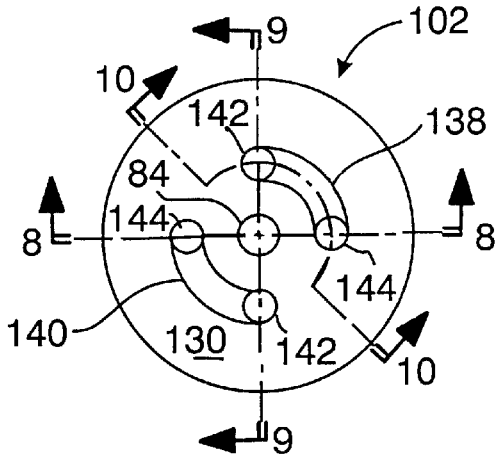
FIG. 7 is a top view of a preferred embodiment of an actuator component of the battery enable/disable switch assembly shown in FIG. 3.
Figure 10:
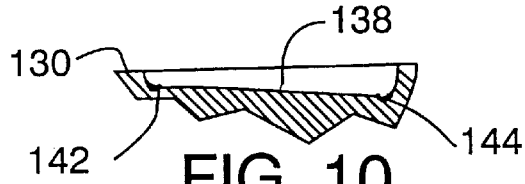
FIG. 10 is a fragmented enlarged cross-sectional elevation view of the switch actuator, taken along the line 10—10 of FIG. 7 in the direction of the appended arrows.
Figure 11:
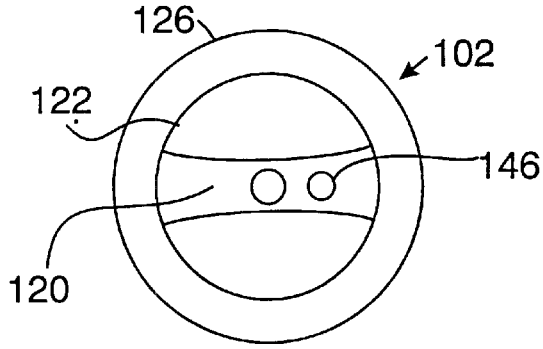
FIG. 11 is a bottom view of the switch actuator of FIG. 7.
Figure 8:
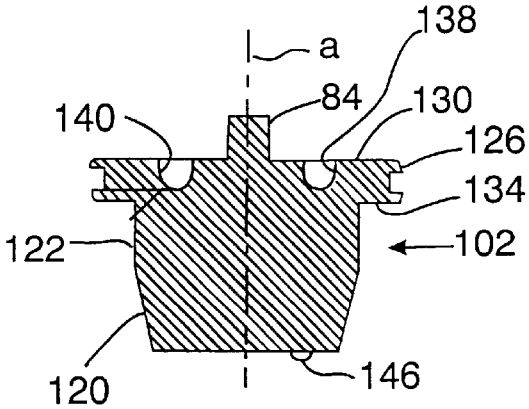
FIG. 8 is a cross-sectional elevation view of the switch actuator of FIG. 7, taken along the line 8—8 of FIG. 7 in the direction of the appended arrows.

The upper surface 130 of the actuator 102 includes two arcuate recesses 138, 140 concentrically spaced about the post 84, the arc of each recess 138, 140 being approximately 90° and opposing one another as shown in FIG. 7. The recesses 138, 140 are positioned and dimensioned for accepting the respective projections 104, 106, and the depth of each recess 138, 140 gradually increases from one end of each arcuate recess to the other, for example by approximately 0.056 inch. Each of the recesses 138, 140 terminate with a detent 142 at one end and a detent 144 at the other end, for being engaged by and releasably retaining the associated projections 104, 106.

As shown in FIG. 3, the projections 104, 106 engage the arcuate recesses 138, 140 respectively, and are maintained in such engagement by action of the compression spring 132. When the actuator handle 120 is in its clockwise position with the projections 104, 106 engaging the lower detents 144, the actuator 102 is upwardly urged by the compression spring 132 to be releasably retained in place with the center post 84 extending beyond the floor 78 sufficiently to lift the battery 58. In this position, the battery's positive terminal 82 does not contact the conductive floor 78; the battery 58 is therefore disabled (FIG. 3). When the actuator handle 120 is rotated 90° counterclockwise (FIG. 9) so that the projections 104, 106 engage the upper detents 142, the actuator 102 is downwardly urged by projections 104, 106 against the compression spring 132 to be releasably retained in place with the top of the center post 84 below the top surface of the floor 78. In this position, the battery 58 is urged downwardly by the helical spring 72 such that the positive terminal 82 contacts the conductive floor 78; the battery is therefore enabled.

The actuator 102 may include a tactile device, such as a protuberance 146 at one side of the handle 120, for permitting the firearm user to tactily determine in darkened environments whether the battery is enabled or disabled without the necessity of making such determination by momentary actuating one of the illuminator switches 92, 94, 98.

A feature of the present invention is the provision of a safety latch device for assuring the secure attachment of the battery retainer cap 76 as well as the enable/disable switch assembly 88 to the battery housing sleeve 62. The safety latch assembly is described below with reference to FIGS. 2, 3 and 5.

The outer surface of the battery retainer cap 76 includes a plurality of circumferentially-spaced vertically-oriented (or axially-oriented) channels or wide grooves 148. The enable/disable actuator retaining cap 116, which is threadedly secured to the battery retainer cap 76 as previously described, is further fixedly secured to the battery retainer cap 76 such as by an adhesive. The latch mechanism consists of a lever 150 that cooperates with any one of the grooves 148 for precluding rotation of the battery retainer cap with respect to the battery sleeve 62, i.e. for precluding unthreading of the retainer cap 76 at threads 66 (FIG. 3). This is of particular importance when the vertical grip device 36 is mounted to a firearm such as a carbine 12 (FIG. 1) which produces vibrations during firing that may (without the locking feature) cause unthreading of the battery retainer cap 76. Such unthreading may result in disablement of the battery 58 and ultimately in the cap 76 separating from the battery sleeve 62 in which case the batteries will fall from the illuminator device 30.

The latch comprises a lever 150 that is pivotable about a pin 152 horizontally secured to the sides of a rectangular cut-out 153 at the bottom of the vertical grip portion 36 of the housing 38, so that the latch 150 is pivotable about its horizontal axis b and radially of the battery retainer cap 76. The lever 150 includes an upper arm 154 and a lower leg 158 on opposite sides of the pivot axis b, and the arm 154 is outwardly radially biased by leaf spring 156 causing the leg 158 to pivot radially inwardly. The leg 158 doglegs radially outwardly to form a boxlike structure having a lower side 160 with lateral ridges for permitting a user to upwardly manipulate the lower side 160 with his thumb to outwardly pivot the leg 158. The width of the latch 150 is slightly less the width of each of the grooves 148 in the battery retainer cap 76.

The latch 150 is shown in its normal latching position in FIG. 3, with the boxlike leg 158 inserted in one of the battery retainer cap grooves 148, thereby preventing rotation of the battery retainer cap 76 with respect to the battery sleeve 62. When relative rotation between these two components 76, 62 is desired, such as when the battery retainer cap 76 is required to be removed and reinstalled for replacement of the battery cells 58 *a, b, c,* the user places his thumb in contact with the ridged surface 160 of the lever leg 158 and outwardly pivots the leg 158 against the bias of the leaf spring 156, until the leg 158 is completely removed from the battery retainer cap groove 148 as shown in FIG. 6. The user forcibly maintains the latch 150 in this position while rotating the cap 76 with respect to the battery sleeve 62 for threadedly removing or reinstalling the cap 76. When the cap 76 is fully installed with one of the grooves 148 aligned with the latch 150, the user releases his thumb from the grooved surface 160 and the leg 158 is urged by the leaf spring 156 to enter and be retained by the aligned groove 148 for securing the cap 76 against rotation as shown in FIG. 3.

Thus, there has been described preferred embodiments of a target and navigation illuminator for firearms. A preferred embodiment includes a vertical handgrip having a battery compartment in the handgrip. A battery retainer cap assembly for the battery compartment includes a battery enable/disable mechanism, and a safety latch is provided on the handgrip or battery housing for assuring the retainer cap assembly's secure attachment to the battery compartment. Other embodiments of the present invention and of its various aspects, and variations of the embodiment and its aspects described herein, may be developed without departing from the essential characteristics thereof. Accordingly, the invention should be limited only by the scope of the claims listed below.

I claim:

1. An illumination apparatus for a firearm, comprising the combination of:

a housing adapted to be secured to the firearm;

a high intensity light source carried by said housing and operable by a user for illuminating a target when said housing is secured to the firearm;

at least one low intensity light source carried by said housing and operable by the user for illuminating the user's surroundings when said housing is secured to the firearm; and said housing including a handgrip having a longitudinal axis substantially vertically disposed beneath a barrel of the firearm when said housing is secured to the firearm and the firearm is horizontally disposed, said housing further including a forward portion carrying said light sources.

2. The apparatus according to claim 1, wherein:

said at least one low intensity light source includes a light emitting diode.

3. The apparatus according to claim 1, including:

a compartment in said handgrip for containing a battery.

4. The apparatus according to claim 3, including:

a replaceably removable battery retainer cap at a lower end of said handgrip for removably retaining the battery in said compartment.

5. The apparatus according to claim 4, including:

a latch carried by said handgrip normally preventing removal of said battery retainer cap.

6. The apparatus according to claim 4, wherein said battery retainer cap is threadedly attached to said lower end of said handgrip and includes a plurality of circumferentially-spaced vertically-oriented grooves along the outer surface thereof;

and including a lever pivotally attached to said handgrip and having a lower leg radially inwardly biased and normally cooperating with a one of said grooves for preventing rotation of said battery retainer cap with respect to said handgrip, said leg including a portion adapted for manipulation by a user for outwardly pivoting said leg from said one groove for permitting the user to rotate said battery retainer cap with respect to said handgrip.

7. The apparatus according to claim 4, including:

a battery in said compartment; and an actuator mounted to said battery retainer cap operable by a user for alternatively connecting and disconnecting said battery in a circuit thereby respectively enabling and disabling said battery.

8. The apparatus according to claim 7, including:

an ON/OFF switch on said housing and operable by the user for alternatively turning on and off said high intensity light source when said battery is enabled.

9. The apparatus according to claim 7, including:

at least one momentary switch on said handgrip operable by the user for momentarily turning on said high intensity light source when said battery is enabled.

10. The apparatus according to claim 7, including:

a momentary switch on said housing operable by the user for momentarily turning on said at least one low intensity light source when said battery is enabled.

11. The apparatus according to claim 7, wherein:

said battery compartment includes an electrically conductive sleeve and said battery retainer cap is electrically conductive and conductively retained by said sleeve for containing said battery with one terminal of said battery in conductive engagement with said battery retainer cap when said battery is enabled and the other terminal of said battery contacting a conductive spring electrically insulated from said sleeve and downwardly biasing said battery, said sleeve and said spring electrically connected to said circuit, said floor having a bore therethrough; and said actuator includes an electrically insulated post in said bore, said actuator actuable by the user for upwardly displacing said post to urge said one terminal of said battery to conductively disengage from said battery retainer cap for disabling said battery and alternatively for downwardly displacing said post such that said one terminal of said battery conductively engages said battery retainer cap for enabling said battery.

12. The apparatus according to claim 11, including an actuator retainer cap rotatably mounting said actuator to said battery retainer cap;

two projections depending from said battery retainer cap and radially spaced from said bore;

two arcuate recesses in said actuator and concentrically spaced about said post for respectively receiving said projections, the depth of each of said recesses increasing from one end to the other end thereof; and a compression spring held by said actuator retainer cap and acting upon said actuator for maintaining said recesses in engagement with said projections.

13. The apparatus according to claim 11, wherein:

each end of each of said arcuate recesses includes a detent for releasably retaining an associated one of said projections.

14. An illumination apparatus for a firearm, comprising me combination of:

a housing adapted to be secured to the firearm, said housing including a handgrip having a longitudinal axis substantially vertically disposed beneath a barrel of the firearm when said housing is secured to the firearm and the firearm is horizontally disposed;

a light source carried by said housing; and a compartment in said handgrip for containing a battery for energizing said light source.

15. The apparatus according to claim 14, wherein:

said light source is a high intensity light source operable by a user for illuminating a target when said housing is secured to the firearm.

16. The apparatus according to claim 14, wherein:

said light source includes at least one low intensity light source operable by the user for illuminating the user's surroundings when said housing is secured to the firearm.

17. The apparatus according to claim 16, wherein:

said at least one low intensity light source includes a light emitting diode.

18. The apparatus according to claim 14, including:

a replaceably removable battery retainer cap at a lower end of said handgrip for removably retaining the battery in said compartment.

19. The apparatus according to claim 18, including:

a latch carried by said handgrip normally preventing removal of said battery retainer cap.

20. The apparatus according to claim 18, wherein said battery retainer cap is threadedly attached to said lower end of said handgrip and includes a plurality of circumferentially-spaced vertically-oriented grooves along the outer surface thereof; and including a lever pivotally attached to said handgrip and having a lower leg radially inwardly biased and normally cooperating with a one of said grooves for preventing rotation of said battery retainer cap with respect to said handgrip, said leg including a portion adapted for manipulation by a user for outwardly pivoting said leg from said one groove for permitting the user to rotate said battery retainer cap with respect to said handgrip.

21. The apparatus according to claim 18, including:

a battery in said compartment; and an actuator mounted to said battery retainer cap operable by a user for alternatively connecting and disconnecting said battery in a circuit thereby respectively enabling and disabling said battery.

22. The apparatus according to claim 21, including:

an ON/OFF switch on said housing and operable by the user for alternatively turning on and off said light source when said battery is enabled.

23. The apparatus according to claim 21, including:

at least one momentary switch on said handgrip operable by the user for momentarily turning on said light source when said battery is enabled.

24. The apparatus according to claim 21, including:

a momentary switch on said housing operable by the user for momentarily turning on said light source when said battery is enabled.

25. The apparatus according to claim 21, wherein:

said battery compartment includes an electrically conductive sleeve and said battery retainer cap is electrically conductive and conductively retained by said sleeve for containing said battery with one terminal of said battery in conductive engagement with said battery retainer cap when said battery is enabled and the other terminal of said battery contacting a conductive spring electrically insulated from said sleeve and downwardly biasing said battery, said sleeve and said spring electrically connected to said circuit, said floor having a bore therethrough; and said actuator includes an electrically insulated post in said bore, said actuator actuable by the user for upwardly displacing said post to urge said one terminal of said battery to conductively disengage from said battery retainer cap for disabling said battery and alternatively for downwardly displacing said post such that said one terminal of said battery conductively engages said battery retainer cap for enabling said battery.

26. The apparatus according to claim 25, including an actuator retainer cap rotatably mounting said actuator to said battery retainer cap;

two projections depending from said battery retainer cap and radially spaced from said bore;

two arcuate recesses in said actuator and concentrically spaced about said post for respectively receiving said projections, the depth of each of said recesses increasing from one end to the other end thereof; and a compression spring held by said actuator retainer cap and acting upon said actuator for maintaining said recesses in engagement with said projections.

27. The apparatus according to claim 26, wherein:

each end of each of said arcuate recesses includes a detent for releasably retaining an associated one of said projections.

28. Firearm and illumination apparatus, comprising in combination:

a firearm including a barrel;

a housing secured to said firearm;

a high intensity light source carried by said housing and operable by a user of said firearm for illuminating a target;

at least one low intensity light source carried by said housing and operable by the user for illuminating the user's surroundings; and said housing including a handgrip having a longitudinal axis substantially vertically disposed beneath said barrel when said barrel is horizontally disposed, said housing further including a forward portion carrying said light sources.

29. The apparatus according to claim 28, wherein:

said at least one low intensity light source includes a light emitting diode.

30. The apparatus according to claim 28, including:

a compartment in said handgrip for containing a battery.

31. The apparatus according to claim 30, including:

a replaceably removable battery retainer cap at a lower end of said handgrip for removably retaining the battery in said compartment.

32. The apparatus according to claim 31, including:

a latch carried by said handgrip normally preventing removal of said battery retainer cap.

33. The apparatus according to claim 31, wherein said battery retainer cap is threadedly attached to said lower end of said handgrip and includes a plurality of circumferentially-spaced vertically-oriented grooves along the outer surface thereof; and including a lever pivotally attached to said handgrip and having a lower leg radially inwardly biased and normally cooperating with a one of said grooves for preventing rotation of said retainer cap with respect to said handgrip, said leg including a portion adapted for manipulation by the user for outwardly pivoting said leg from said one groove for permitting a user to rotate said battery retainer cap with respect to said handgrip.

34. The apparatus according to claim 31, including:

a battery in said compartment; and an actuator mounted to said battery retainer cap operable by the user for alternatively connecting and disconnecting said battery in a circuit thereby respectively enabling and disabling said battery.

35. The apparatus according to claim 34, including:

an ON/OFF switch on said housing and operable by the user for alternatively turning on and off said high intensity light source when said battery is enabled.

36. The apparatus according to claim 34, including:

at least one momentary switch on said handgrip operable by the user for momentarily turning on said high intensity light source when said battery is enabled.

37. The apparatus according to claim 34, including:

a momentary switch on said housing operable by the user for momentarily turning on said at least one low intensity light source when said battery is enabled.

38. The apparatus according to claim 34, wherein:

said battery compartment includes an electrically conductive sleeve and said battery retainer cap is electrically conductive and conductively retained by said sleeve for containing said battery with one terminal of said battery in conductive engagement with said battery retainer cap when said battery is enabled and the other terminal of said battery contacting a conductive spring electrically insulated from said sleeve and downwardly biasing said battery, said sleeve and said spring electrically connected to said circuit, said floor having a bore therethrough; and said actuator includes an electrically insulated post in said bore, said actuator actuable by the user for upwardly displacing said post to urge said one terminal of said battery to conductively disengage from said battery retainer cap for disabling said battery and alternatively for downwardly displacing said post such that said one terminal of said battery conductively engages said battery retainer cap for enabling said battery.

39. The apparatus according to claim 38, including an actuator retainer cap rotatably mounting said actuator to said battery retainer cap;

two projections depending from said battery retainer cap and radially spaced from said bore;

two arcuate recesses in said actuator and concentrically spaced about said post for respectively receiving said projections, the depth of each of said recesses gradually increasing from one end to the other end thereof; and a compression spring held by said actuator retainer cap and acting upon said actuator for maintaining said recesses in engagement with said projections.

40. The apparatus according to claim 38, wherein:

each end of each of said arcuate recesses includes a detent for releasably retaining an associated one of said projections.

41. Firearm and illumination apparatus, comprising in combination:

a firearm including a barrel;

a housing secured to said firearm, said housing including a handgrip having a longitudinal axis substantially vertically disposed beneath said barrel when said firearm is horizontally disposed;

a light source carried by said housing; and a compartment in said handgrip for containing a battery for energizing said light source.

42. The apparatus according to claim 41, wherein:

said light source is a high intensity light source operable by a user for illuminating a target.

43. The apparatus according to claim 41, wherein:

said light source includes at least one low intensity light source operable by the user for illuminating the user's surroundings.

44. The apparatus according to claim 43, wherein:

said at least one low intensity light source includes a light emitting diode.

45. The apparatus according to claim 41, including:

a replaceably removable battery retainer cap at a lower end of said handgrip for removably retaining the battery in said compartment.

46. The apparatus according to claim 45, including:

a latch carried by said handgrip normally preventing removal of said battery retainer cap.

47. The apparatus according to claim 45, wherein said battery retainer cap is threadedly attached to said lower end of said handgrip and includes a plurality of circumferentially-spaced vertically-oriented grooves along the outer surface thereof; and including a lever pivotally attached to said handgrip and having a lower leg radially inwardly biased and normally cooperating with a one of said grooves for preventing rotation of said battery retainer cap with respect to said handgrip, said leg including a portion adapted for manipulation by a user for outwardly pivoting said leg from said one groove for permitting the user to rotate said battery retainer cap with respect to said handgrip.

48. The apparatus according to claim 45, including:

a battery in said compartment; and an actuator mounted to said battery retainer cap operable by a user for alternatively connecting and disconnecting said battery in a circuit thereby respectively enabling and disabling said battery.

49. The apparatus according to claim 48, including:

an ON/OFF switch on said housing and operable by the user for alternatively turning on and off said light source when said battery is enabled.

50. The apparatus according to claim 48, including:

at least one momentary switch on said handgrip operable by the user for momentarily turning on said light source when said battery is enabled.

51. The apparatus according to claim 48, including:

a momentary switch on said housing operable by the user for momentarily turning on said light source when said battery is enabled.

52. The apparatus according to claim 48, wherein:

said battery compartment includes an electrically conductive sleeve and said battery retainer cap is electrically conductive and conductively retained by said sleeve for containing said battery with one terminal of said battery in conductive engagement with said battery retainer cap when said battery is enabled and the other terminal of said battery contacting a conductive spring electrically insulated from said sleeve and downwardly biasing said battery, said sleeve and said spring electrically connected to said circuit, said floor having a bore therethrough; and said actuator includes an electrically insulated post in said bore, said actuator actuable by the user for upwardly displacing said post to urge said one terminal of said battery to conductively disengage from said battery retainer cap for disabling said battery and alternatively for downwardly displacing said post such that said one terminal of said battery conductively engages said battery retainer cap for enabling said battery.

53. The apparatus according to claim 52, including an actuator retainer cap rotatably mounting said actuator to said battery retainer cap;

two projections depending from said battery retainer cap and radially spaced from said bore;

two arcuate recesses in said actuator and concentrically spaced about said post for respectively receiving said projections, the depth of each of said recesses increasing from one end to the other end thereof; and a compression spring held by said actuator retainer cap and acting upon said actuator for maintaining said recesses in engagement with said projections.

54. The apparatus according to claim 53, wherein:

each end of each of said arcuate recesses includes a detent for releasably retaining an associated one of said projections.

* * * * *